United States Patent [19]

Hayami et al.

[11] 4,043,805

[45] Aug. 23, 1977

[54] ISOTROPIC AND HIGH-STRENGTH HIGH SILICON STEEL SHEET

[75] Inventors: Satohiro Hayami; Jun Imamura; Hiroshi Hayakawa; Tadatzugu Yabuta, all of Yokohama, Japan

[73] Assignee: Nippon Steel Corporation, Tokyo, Japan

[21] Appl. No.: 632,692

[22] Filed: Nov. 17, 1975

Related U.S. Application Data

[63] Continuation of Ser. No. 477,098, June 6, 1974, abandoned.

[30] Foreign Application Priority Data

June 11, 1973 Japan ..... 48-65538

[51] Int. Cl.[2] ..... C22C 33/00; H01F 1/04

[52] U.S. Cl. ..... 75/123 L; 75/126 Q; 148/12 F; 148/110; 148/111

[58] Field of Search ..... 75/123 L, 123 N, 124, 75/126 B, 126 Q; 148/2, 3, 12 F, 36, 110, 111

[56] References Cited

U.S. PATENT DOCUMENTS

| | | | |
|---|---|---|---|
| 3,711,340 | 1/1973 | Korchynsky et al. | 148/36 |
| 3,945,858 | 3/1976 | Matsubara et al. | 148/2 |

FOREIGN PATENT DOCUMENTS

| | | | |
|---|---|---|---|
| 45-4172 | 1970 | Japan | 75/123 |
| 277,248 | 10/1970 | U.S.S.R. | 75/123 |

OTHER PUBLICATIONS

Metallurgical Transactions, vol. 1, Dec. 1970, pp. 3341–3350.

*Primary Examiner*—Walter R. Satterfield
*Attorney, Agent, or Firm*—Toren, McGeady and Stanger

[57] ABSTRACT

A silicon-containing high strength steel sheet having isotropic high ductility and toughness in all directions independently of the rolling direction comprising 0.03 to 0.15% C, 0.7 to 2.3% Si, 0.7 to 2.0% Mn with the balance being iron and unavoidable impurities, in which the ratio of Si/Mn is between 0.6 and 1.5 and the content of S is maintained in an amount as low as possible below that normally contained as an unavoidable impurity.

7 Claims, 13 Drawing Figures

(x500)

(x200)

EDGE PORTION IN TRANSVERVE DIRECTION (x500)

(x200)

1/4 POSITION FROM THE EDGE PORTION IN TRANSVERSE DIRECTION (x100)

(c) (x500)

(L) (x500

ISOTROPIC AND HIGH-STRENGTH HIGH SILICON STEEL SHEET

Figure 1A:
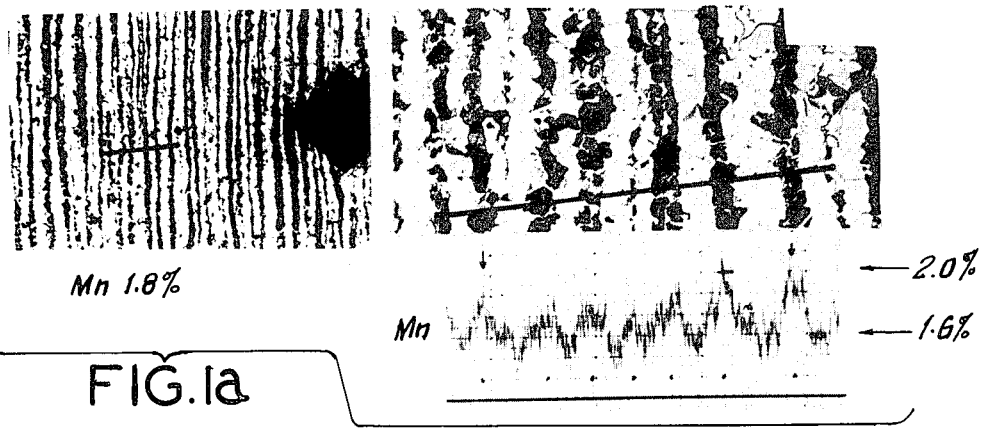
Figure 1B:
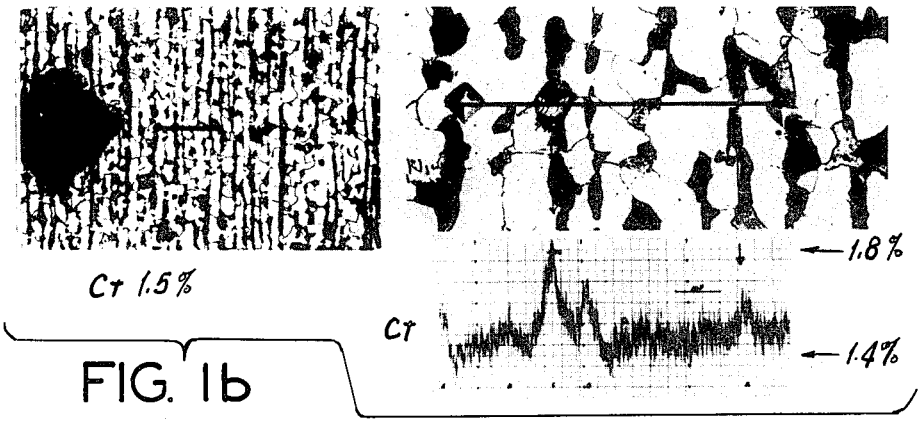
Figure 1C:
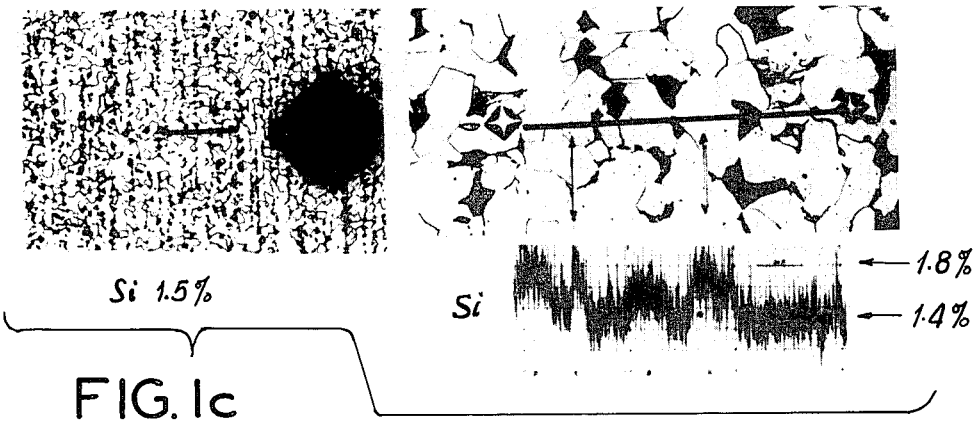
Figure 1D:
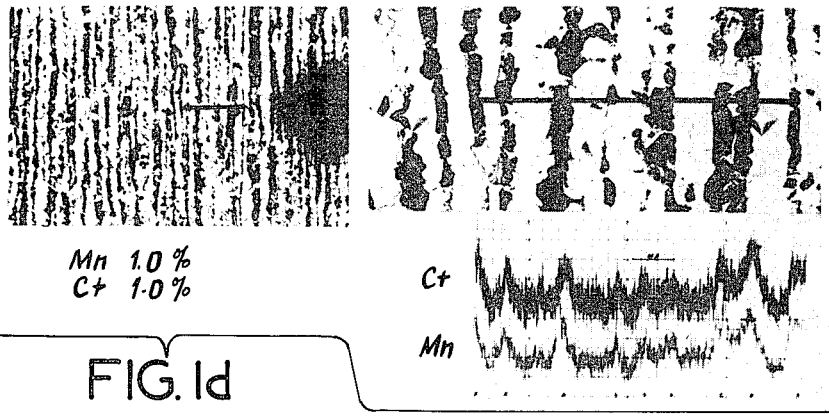
Figure 1E:
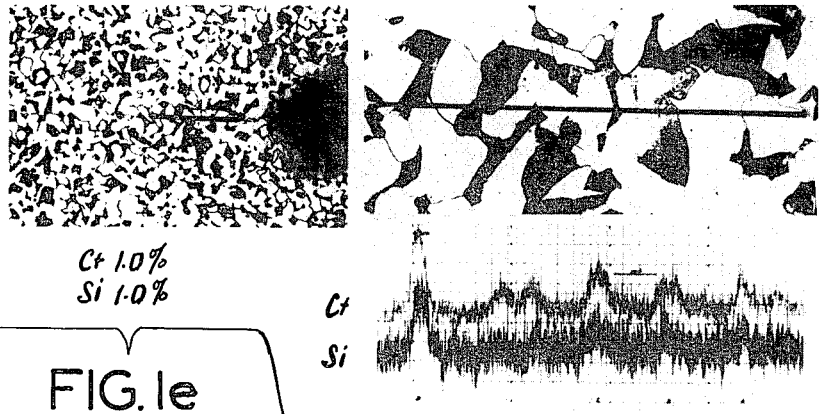
Figure 1F:
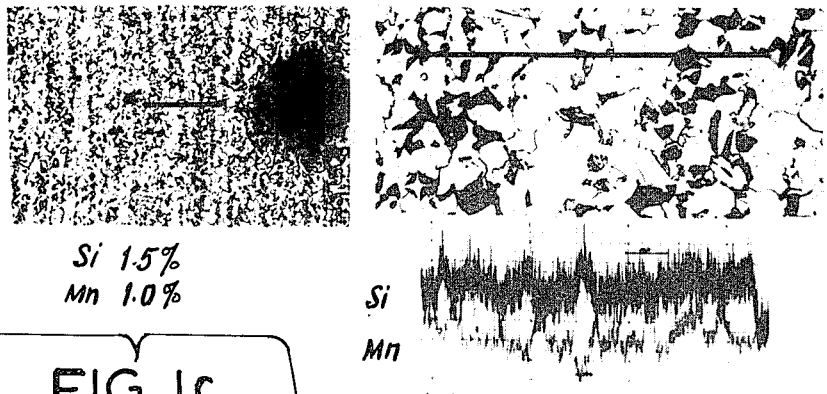
Figure 2B:
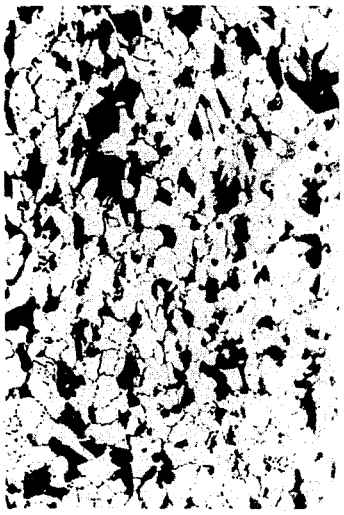
Figure 2A:
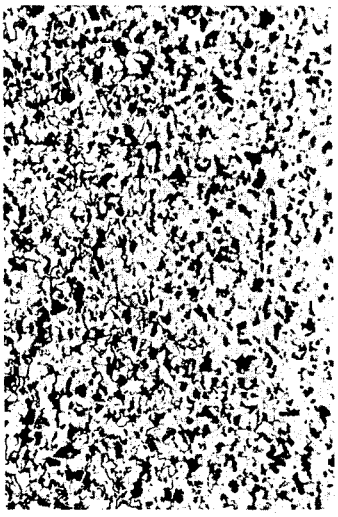
Figure 2D:
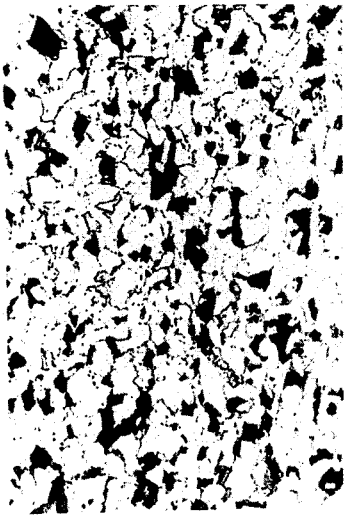
Figure 2C:
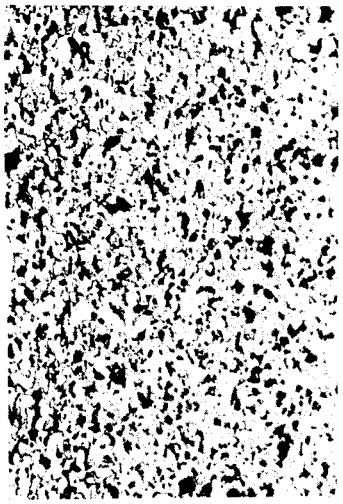

This is a continuation of Application Ser. No. 477,098 filed on June 6, 1974 and now abandoned.

The present invention relates to a high strength steel having a high n value (work hardening exponent or uniform elongation), high ductility and toughness but less unisotropy in mechanical properties in spite of high strength, and further the present invention relates to middle gauge steel plate, and hot and cold rolled steel sheets obtained by continuous hot rolling with or without subsequent heat treatment, cold rolling and annealing.

In recent years, significant developments have been made in motor vehicle, particularly automobiles toward safety and pollution-free cars, such as provisions for pollution-prevention devices against exhaust gases, etc., and safety devices in the case of a crash. These improvements have resulted in the increased weight of cars. Therefore, it is necessary to reduce the car weight by using a high-strength low-alloy steel.

Meanwhile, in the field of trucks for transporting heavy freights and other inductrial machines, a high-strength steel sheet of 60 to 100 kg/mm$^2$ strength having a good bending property and weldability has come to be used for the purpose of reducing the weight of the truck and machines. The high-strength steel is available in a wide variety of thicknesses, and the required levels of its desirable properties has been steadily raised.

In particular, there are many technical problems to be solved with respect to the material quality, such as, the demand for high-ductility steel which retains ductility at a level as high as possible against the inevitable deterioration which normally takes place as the strength is increased, or the demand for thin steel sheets having excellent isotropic ductility in spite of a remarkable deterioration of ductility and increased unisotropy between the strength and ductility (particularly the difference between the longitudinal and transverse direction) caused by the decreasing the sheet thickness. With respect to production processes, the demand has been for low-cost steels showing excellent properties without the addition of expensive elements, such as, B, Mo and Ni. There has also been a demand for stable production of high strength steels at a high level of yield, as well as for the stable production of both hot rolled steel sheets and cold rolled steel sheets.

The present inventors have discovered very effective means for solving the above noted difficult problems on the basis of the following three basic considerations, and have completed the present invention. For the improvement of ductility:

1. increasing the n value;
2. Refinement of the grain structure, i.e., uniform distribution and apparent reduction of the secondary phase (pearlite structure and inclusions). For elimination of the directionality of the mechanical properties:
3. maintenance of an isotropic structure and an effective distribution of the micro segregation of the main added elements.

Generally, the total elongation (T.El) which is a measure for ductility in the case of uni-axial stretcher deformation is expressed by the sum of uniform elongation ($\epsilon^*$) and local elongation ($\epsilon L$), and the improvement of the n value may be considered to be identical to the improvement of the uniform elongation ($\epsilon^*$) and is an effective measure for the improvement in the ductility so long as it does not reduce the local elongation.

In other words, it is important to find out a method for maintaining the n value, which sharply lowers as the strength is increased, at a high level. On the other hand, considering the aspect of plastic deformation and ductile fracture, the apparent reduction, refinement and uniform distribution of pearlite and inclusions are effective not only for improving the uniform elongation, but also, for improving the local elongation. In steels having refined grains, the proportion of the pearlite is naturally small and refinement of the ferrite grains is satisfactory and the colony size of the pearlite is small in a uniform distribution. On the contrary when the steels have coarsened grains, contrary phenomena occur.

In a pearlitic steel having refined grains, both of the n value ($\epsilon^*$) and local elongation ($\epsilon L$) are improved, resulting in remarkable improvement of the ductility. These facts indicate that the amelioration of the structure plays a large part in the improvement in the ductility and that the refinement of grain structure as above is an effective measure for improvement of the ductility and toughness.

Alloy steels for practical use are inevitably accompanied by segregation of the added or accompanying elements. However, in case of a ferrite-pearlite structure, the finally transformed phase (excluding the ferrite matrix), and inclusions, particularly the elongated inclusions such as, MnS are reduced and dispersed finely and uniformly. If, therefore it is possible to obtain an isotropic steel by refining the structure so as to uniformly disperse the adverse effects of the strengthening elements, such as, Mn, Si and Cr as well as the impurities (such as C, O and S) accompanying these elements in spite of their possible segregation; results can be attained which are almost the same as those obtained by a segregation-free state and to eliminate the directionality of properties.

Therefore, the present inventors have conducted various extensive experiments in connection with the above three considerations for establishing measures for obtaining an isotropic steel having excellent ductility and toughness.

The feature of the present invention lies in that the steel of the present invention contains silicon in an amount far more than usually contained in commercial thin guage and intermediate-guage steel sheets for the purpose of attaining high strength and high ductility and toughness in the form of thin-guage and intermediate-guage steel sheet, and that the ratio of Si/Mn is maintained between 0.6 and 1.5 and the sulfur content in the steel is maintained as low as possible i.e., lower than that usually contained as unavoidable impurity, and preferably not more than 0.01%.

Thus the isotropic and high strength steel having high ductility and toughness of the present invention contains 0.03 to 0.15% C, 0.7 to 2.3% Si and 0.7 to 2.0% Mn with the balance being iron and unavoidable impurities, in which Si/Mn is between 0.6 and 1.5, preferably 0.8 and 1.1, and the sulfur content is maintained as low as possible from than that usually contained as an unavoidable impurity, and preferably not more than 0.01%.

Further the steel of the present invention may contain one or more of Cr, Nb, V, Ti, Al and Cu in amounts of not more than 0.5% for Cr and Cu, not more than 0.4% for Nb, V and Ti each, and not more than 0.1% for Al.

Further the steel of the present invention may contain Ce and/or Zr in an amount so as to attain Ce/S = 1.5 to 2.0 and Zr/S>2.

Hereinunder, explanations are set forth concerning each of the three measures as are the reasons for limiting the components as above, referring to the attached drawings.

Figure 3A:
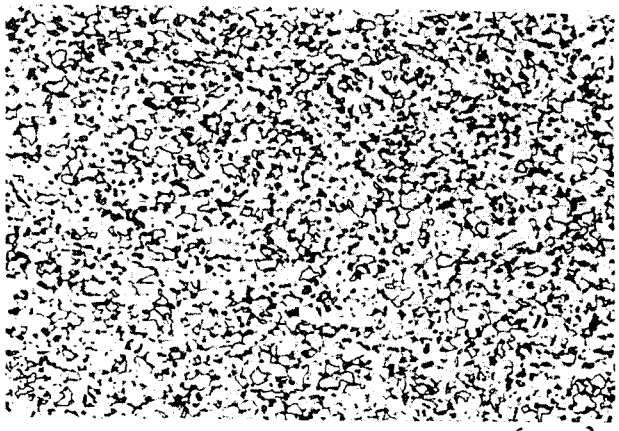
Figure 3B:
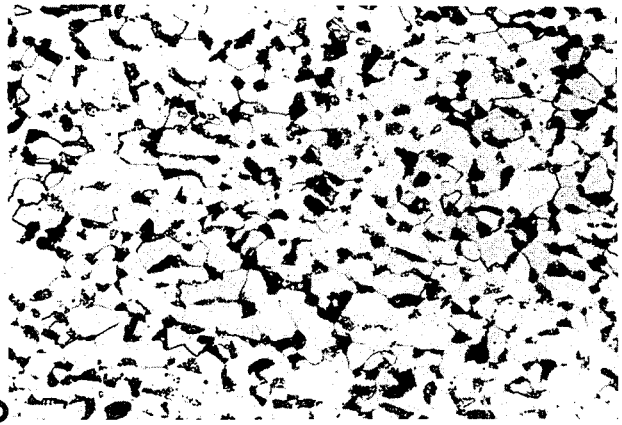
Figure 3C:
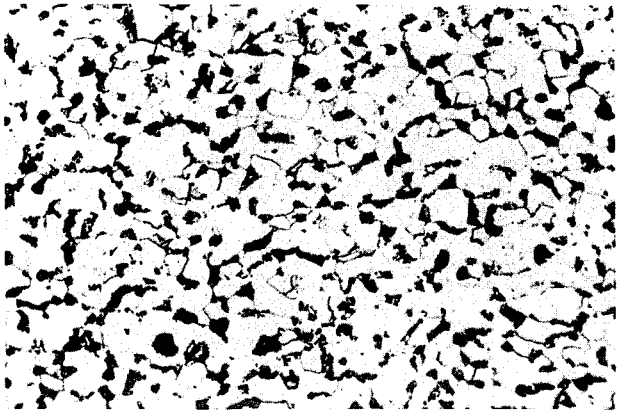

FIGS. 1 - 3 are micro-photographs showing the cross sections of steel sheet samples and results of EPMA.

1. The n value improvement:

Among Si-added steels having a similar level of strength, the n value can be maintained at a higher level as compared with that of a steel having a lower silicon content. The lower limit of the silicon content is 0.7%. Also the n value can be maintained at a high level with a ratio of Si/Mn between 0.6 and 1.5. Outside this range, the n value lowers.

2. Refinement of the structure, dispersion and reduction of the second-phase:

As seen in FIG. 1-A (a), (b) and (c), in the case of the addition of Si in single, the ferrite grains are refined, the pearlite phase has a small colony size and is distributed uniformly, and thus an ideal structure for improving the ductility is assured. On the other hand, in cases of the addition of Mn and Cr alone the colony size of the pearlite is large in both cases, and the so called pearlite band is formed. In addition, the ferrite grains are not uniform, which is unfavourable for the ductility and appears to promote the directionality. However, as shown in FIG. 1-B (d), (e) and (f), very remarkable changes are caused by the combined addition of Si + Mn.

The ideal structure of a high-Si steel is hardly destroyed by the addition of Mn. The conditions for attaining such an ideal structure depend on the ratio of Si/Mn just as in case of the n value improvement, and in this case, also the ratio of Si/Mn should be between 0.6 and 1.5, and the best results can be obtained when the ratio is between 0.8 and 1.1.

Meanwhile, regarding the inclusions, an increased amount of Si and Mn causes changes in the composition of the inclusions, and the inclusions are finely broken during the rolling and finely and uniformly despersed into the matrix. Also it is possible to reduce the elongated inclusion, MnS, as low as possible in the high-Mn steel by reducing the sulfur content. Particularly when the sulfur content is maintained at not more than 0.01%, or elements such as Zr, Ce and Ti which control the form of the sulfides are added, the above favourable conditions are promoted.

The combined addition of Mn + Cr gives a strong banding structure with enhanced effect of each of Mn and Cr (FIG. 1-B(d)). On the other hand, the combined addition of Si + Cr causes almost complete disappearance of the band structure, but the tendency of micro segregation is similar as in case of the combined addition of Mn + Cr. The grains obtained by this combined addition have the largest grain particle diameter among the grain sizes obtained by the other two types of additions of Mn + Cr and Si + Mn, and the pearlite colony size obtained by this addition is extremely large.

3. Elimination of unisotropy:

It has been found that the synergetic effects by the refinement and uniform dispersion of inclusions, the finely and uniformly dispersed isotropic structure and the unique micro segregation of Si and Mn which are strengthening elements contributes remarkably to eliminate the directionality when the contents of Si and Mn are increased, the sulfur content is reduced and the ratio of Si/Mn is maintained between 0.6 and 1.5, preferably 0.8 and 1.1.

For elimination of the directionality, it is necessary to control various factors ranging from the inclusions to the micro segregation other than the structural modification. There has been no success in the attempt to produce an isotropic high-strength steel with excellent ductility and toughness by controlling only the silicon content, the ratio of Si/Mn, and reduction of the sulfur content.

The reasons for limitation of the component elements in the present invention will be explained hereinunder.

1. Carbon

Carbon is most effective to strengthen the steel at low cost. However, the strengthening of the steel by carbon depends on the proportion of the pearlite content, and increase of this proportion remarkably deteriorates ductility and thus a large addition of carbon is not desirable. The upper limit of the carbon content has been limited to 0.15%, because a carbon content up to 0.15% does not cause a problem in connection with the balance between strength and ductility. On the other hand, it is very advantageous to reduce the carbon content as low as premitted by the required strength and the lower limit has been set at 0.03% for assuring a strength not lower than 50 kg/mm$^2$ and in view of the limits in the steel making plant.

2. Silicon

Although the strengthening effect of silicon is not as remarkable as that of carbon, silicon is indispensable for increasing the strength when the carbon content is maintained low, and is useful as an auxiliary strengthening element. An even more important effect of the silicon is, as mentioned before, the surprising increase of the n value and amelioration of the structure attained by combination with manganese. The improvement of the n value is not attained with a silicon content less than 0.42%, but it is remarkable with a silicon content of more than 0.5% and, particularly more than 0.7%. On the other hand, the effects of silicon remain until the silicon content reaches 3%, and thus it is considered that a silicon content up to 3% is effective. But high silicon contents cause deterioration of the surface scale and difficulties in the steel making operation. Thus, the silicon content is limited to 2.3% as its upper limit.

3. Manganese

Although manganese is less effective than carbon and silicon for solid solution strengthening, it is useful as a strengthening element which does not deteriorate the ductility. Particularly, when the manganese is added in a range of 0.6 to 1.5, preferably 0.8 to 1.1 as Si/Mn as mentioned before and is distributed uniformly and appropriately, it is possible to eliminate the directionality of properties. Manganese is indispensable for assuring the isotropy of the steel materials. In order to maintain the required strength and at the same time to assure the appropriate balance and distribution of silicon and manganese, it is necessary to limit the manganese content to from 0.7% to 2.0%.

4. Chromium

Chromium, when added in an amount more than 1%, is effective to strengthen the steel. When present together with manganese, it increases the directionality, but maintains the uniform elongation ($\epsilon^*$) at a high level. However, the strengthening effect of chromium is low and a large amount of chromium is required to strengthen the steel and is not economically advanta- Table 2-(2)

| Steels | Sheet Thickness | Direction | T.S. (kg/mm²) | Y.P. (kg/mm²) | T.El (%) | Minimum Bend Radii | n Value |
|---|---|---|---|---|---|---|---|
| Inventive Steel D | 3.2mm | L | 64.5 | 50.5 | 31.0 | | 0.18 |
| | | C | 65.0 | 51.3 | 31.0 | 0t | — |
| | 2.3mm | L | 61.6 | 46.0 | 31.0 | | 0.17 |
| | | C | 62.0 | 47.0 | 30.0 | 0t | — |
| 60 kg/mm² Steel E | 6.0mm | L | 61.2 | 47.7 | 27.5 | | 0.10 |
| for Comparison | | C | 62.7 | 48.2 | 26.0 | 1t | — |

Similar as the inventive steels A and B having tensile strength of 50 kg/mm² order, the balance between strength and ductility and the isotropy of the inventive steel D are surprisingly excellent, and the steel D shows a remarkably high n value and ductility as compared with the conventional steel, and it is also understood that the steel D can be bent in the transverse and longitudinal directions with a bending angle of 0 and thus the present inventive steel has a very high level of properties. In particular, it should be noted that the present inventive steel sheet shows excellent ductility even in a sheet thickness of 2.3mm as compared with a 6mm thickness of the comparative steel sheet.

As clearly understood from FIG. 2, the steel D of the present invention is almost completely free from unisotropy and thus is isotropic.

EXAMPLE 3

This example corresponds to claims 4 and 5, and the steels F,G,H,I,J and K contain No, V and Ti (Si/Mn between 1.1 to 0.62) and the steels M and N contain more than 0.01% S and Ce and Zr in the range specified in the present invention. On the other hand, the comparative steel 2 contains a similar level of sulfur as in the present invention. The production conditions were same as in Example 1 and finished into a sheet thickness of 6mm.

As understood from Table 3, the strengthductility balance of the present inventive steels is at the highest level as compared with the conventional steels of 50, 60, 65 and 70 kg/mm², and the present inventive steels is a very excellent, isotropic steel having a remarkably high ductility and is almost free from the directionality. The directionality of properties and the lowering of the n value which are seen in the conventional Nb steels, Nb-V steels and Ti steels have been completely overcome by the present invention. It has been confirmed by the results of this example that the inherent properties of the base steel composition of the present invention are retained even when Ti, Nb and V are added.

On the other hand, in the case of the steels M and N containing more than 0.01% S, the ductility in the C direction, the reduction of area and the bending property of the steel N with the addition of Zr (Zr/S>2) and the steel N with addition of Ce (Ce/S~1.8) are restored to the level of the low-sulfur steel, and thus the adverse effect of the sulfur content are eliminated by these elements, as is clear from the comparison with the comparative steel 2.

In the present inventive steel, Nb and V show completely the same effects and they may be added in single or in combination.

EXAMPLE 4

The inventive steel D in Example 2 was cold rolled and then subjected to box annealing and continuous annealing, and various properties of these cold rolled steel sheets are shown in Table 4.

Table 3-(1)

| | Chemical Compositions (%) | | | | | | | | | | |
|---|---|---|---|---|---|---|---|---|---|---|---|
| | C | Si | Mn | Cr | No | V | Ti | S | Zr | Ce | Si/Mn |
| Inventive Steel F | 0.049 | 1.08 | 0.99 | — | 0.03 | — | — | 0.006 | — | — | 1.09 |
| Steel G | 0.054 | 0.86 | 1.39 | — | 0.04 | — | — | 0.006 | — | — | 0.62 |
| Steel H | 0.10 | 0.94 | 0.96 | 0.21 | — | — | 0.14 | 0.007 | — | — | 0.98 |
| Steel I | 0.10 | 1.03 | 0.98 | 0.25 | — | — | 0.27 | 0.008 | — | — | 1.05 |
| Steel J | 0.08 | 1.10 | 1.00 | — | 0.03 | 0.04 | — | 0.005 | — | — | 1.10 |
| Steel K | 0.08 | 1.01 | 0.98 | — | 0.03 | — | 0.08 | 0.006 | — | — | 1.03 |
| Steel M | 0.09 | 0.98 | 1.02 | — | — | — | — | 0.020 | 0.048 | — | 0.96 |
| Steel N | 0.09 | 0.96 | 0.99 | 0.20 | — | — | — | 0.018 | — | 0.032 | 0.97 |
| Comparative Steel 2 | 0.10 | 1.02 | 1.00 | — | — | — | — | 0.021 | — | — | 1.02 |

Table 3-(2)

| Steel | Direction | T.S. (kg/mm²) | Y.P. (kg/mm²) | T.El (%) | Reduction of Area (ϕ)(%) | n Value | Minimum Bend Radii (transverse direction) |
|---|---|---|---|---|---|---|---|
| F | L | 53.0 | 41.5 | 34.2 | 80.0 | 0.190 | 0t |
| | C | 53.5 | 41.5 | 33.5 | 79.0 | 0.188 | |
| G | L | 62.0 | 46.0 | 31.5 | 76.0 | 0.190 | 0t |
| | C | 63.0 | 47.0 | 31.0 | 76.5 | 0.186 | |
| H | L | 66.5 | 54.0 | 30.0 | 75.0 | 0.180 | 0t |
| | C | 67.0 | 54.0 | 30.0 | 74.0 | 0.178 | |
| I | L | 72.0 | 59.5 | 28.0 | 77.0 | 0.180 | 0t |
| | C | 72.5 | 59.5 | 27.0 | 76.0 | 0.170 | |
| J | L | 67.0 | 55.0 | 28.9 | 78.0 | 0.182 | |

geous. On the other hand, when the chromium content is reduced from 0.5% to 0 the uniform elongation sharply increases while the strength is not affected substantially, and chromium contents up to 0.5% are effective to improve the reduction of area (ϕ) and thus is useful for improvement of the bending property. Based on the above combined factors the upper limit of the chromium content is set at 0.5%.

5. Sulfur

As described hereinbefore, the reason for limiting the sulfur content to an amount as low as possible below the amount usually contained as an unavoidable impurity, and preferably not more than 0.01% is for the to minimize the elongated inclusions (MnS) which exert an adverse effect on the directionality and improvement of the workability and impact property in the transverse direction, and elimination of their directionality.

In the case of the hot rolled steel sheet, the sulfur is restricted severely as above, but in case of the cold rolled steel sheet, sulfur is not restricted as severely and is allowed to be present up to about 0.020%, because the elongated inclusions are broken into fine pieces during the cold rolling and the sulfur becomes less harmful.

For the improvement of the workability and impact property in particular, Ce, Ti and Zr are added in amounts so as to maintain the Ce/S = 1.5 to 2.0, Ti/S>4, Zr/S>2. With these additions, high strength and high ductility and toughness of the present inventive steel are further promoted, and the directionality of the properties which is unavoidable for conventional high strength steels can be completely eliminated.

Further, when one or more of precipitation hardening elements, Nb, V and Ti is added to the base composition of the present inventive steel in an amount up to 0.4%, not only can be useful increase of strength be obtained, but also it is possible to eliminate the directionality of a properties which could not be eliminated by conventional precipitation hardening high strength steels, and to obtain a high n value and high ductility and toughness.

Still further, copper addition of up to 0.5% is effective for solid-solution strengthening and, also is effective in combination with Si and P (up to 0.02%) for improving the resistance against weather and sea water. Meanwhile aluminum addition up to 0.1% is necessary for killing the steel.

According to the present invention, it is possible to produce a cold rolled steel sheet or strip having excellent workability by cold rolling alone or with subsequent ordinary box annealing or continuous annealing, utilizing the features of the steel composition and less dependency of the steel composition on annealing temperature. After the annealing, the annealed steel sheet is preferably subjected to ordinary skin pass rolling in order to enhance the yield point.

The present invention will be more clearly understood from the following examples.

EXAMPLE 1

20 kg ingots of steels A and B according to the present invention, and a comparative steel C as shown in Table 1-(1) were prepared by a vacuum melting furnace, soaked at 1250° C for two hours, hot rolled down to 6mm thickness at a finishing temperature of 930° C, cooled in air and their mechanical properties were measured. As shown in Table 1-(2), the comparative steel C which is supposed to have a highest level of properties, is inferior to the present inventive steels A and B which are free from unisotropy and show a surprisingly high n value. It is also understood that the reduction of area which corresponds to the bendability is improved with a chromium content of 0.2%. The reduction of area in the C direction of the present inventive steels is equal or better than that of the comparative steel (1.02% Cr), both of which exceed 75%. This means it is possible for the sheet to be bent flat upon themselves even in the transverse direction.

The ductility of the present inventive steel is isotropic while the comparative steel was revealed to have L, C unisotropy. This is assumed to be due to the difference in the micro segregation or inclusions.

Table 1-(1)

| | Chemical Composition (%) | | | | | | | |
|---|---|---|---|---|---|---|---|---|
| | C | Si | Mn | Cr | P | S | Al | Si/Mn |
| Inventive Steel B | 0.09 | 0.93 | 1.05 | 0.21 | 0.001 | 0.006 | — | 0.89 |
| Steel A | 0.10 | 1.04 | 0.97 | — | 0.001 | 0.006 | — | 1.04 |
| Comparative Steel C | 0.10 | 0.93 | 0.57 | 1.02 | 0.001 | 0.006 | — | 1.86 |

Table 1-(2)

| | | Mechanical Property | | | | |
|---|---|---|---|---|---|---|
| Steels | Direction | T.S. (kg/mm²) | Y.P. (kg/mm²) | T.El (%) | Reduction of Area(ϕ) (%) | n Value* |
| Inventive Steel B | L | 51.2 | 34.6 | 41.5 | 81.3 | 0.26 |
| | C | 51.4 | 34.6 | 40.8 | 80.8 | 0.26 |
| Steel A | L | 50.3 | 32.7 | 41.4 | 78.9 | 0.27 |
| | C | 50.0 | 32.8 | 41.3 | 78.6 | 0.27 |
| Comparative Steel C | L | 51.4 | 34.9 | 35.1 | 78.2 | 0.20 |
| | C | 51.1 | 35.6 | 32.7 | 76.0 | 0.21 |

*10 – 15% . two-point method

EXAMPLE 2

As shown in Table 2, steel compositions having no substantial difference except for Si and V were selected and compared. Both of the steels were prepared by a convertor. The present inventive steel D, in spite of its large ingot size, is free from composition variations from the coil top to the coil bottom and free from directionality in the transverse direction (right angle to rolling direction) and the D direction (45° to rolling direction), and is very isotropic, showing a good production yield. The measurements of the mechanical properties were done at the middle portion of the ingots.

Table 2-(1)

| | Chemical Composition (%) | | | | | | | | |
|---|---|---|---|---|---|---|---|---|---|
| | C | Si | Mn | Cr | P | S | Al | V | Si/Mn |
| Inventive Steel D | 0.12 | 1.40 | 1.62 | 0.34 | 0.015 | 0.009 | 0.015 | — | 0.86 |
| 60kg/mm² Steel E for Comparison | 0.13 | 0.42 | 1.38 | 0.21 | 0.019 | 0.008 | 0.019 | 0.014 | 0.30 |

Table 3-(2)-continued

| Steel | Direction | T.S. (kg/mm²) | Y.P. (kg/mm²) | T.El (%) | Reduction of Area (ϕ)(%) | n Value | Minimum Bend Radii (transverse direction) |
|---|---|---|---|---|---|---|---|
| | | | | | | | 0t |
| | C | 67.5 | 55.2 | 28.2 | 78.0 | 0.180 | |
| K | L | 75.3 | 58.3 | 27.2 | 77.0 | 0.175 | |
| | | | | | | | 0t |
| | C | 76.4 | 59.1 | 27.0 | 76.0 | 0.175 | |
| M | L | 50.6 | 32.8 | 41.0 | 78.7 | 0.270 | |
| | | | | | | | 0t |
| | C | 50.4 | 33.1 | 40.8 | 78.1 | 0.270 | |
| N | L | 51.1 | 34.8 | 40.8 | 78.3 | 0.265 | |
| | | | | | | | 0t |
| | C | 50.8 | 34.4 | 40.6 | 78.5 | 0.265 | |
| Comparative | L | 50.4 | 33.1 | 41.3 | 78.8 | 0.260 | |
| | | | | | | | 0.5t |
| Steel 2 | C | 50.2 | 33.0 | 39.3 | 68.4 | 0.270 | |

Table 4

| | Y.P. (kg/mm²) | T.S. (kg/mm²) | T.El (%) | n Value | r Value |
|---|---|---|---|---|---|
| Box annealing 750° C | 44.0 | 63.0 | 30.0 | 0.192 | 1.25 |
| Continuous Annealing 700° C | 48.5 | 65.0 | 27.0 | 0.185 | 1.19 |
| " 800° C ×3min. +400° C ×5min. | 72.5 | 89.5 | 21.0 | — | — |

As clear from the above results, the properties of the hot rolled steel sheets are not lost at all when they are further cold rolled.

FIG. 3 shows the longitudinal and transverse cross sections of the box annealed steel, which indicates a finely and uniformly dispersed structure.

What is claimed is:

1. A high silicon steel composition consisting essentially of 0.03 to 0..15% carbon,
0.7 to 2.3% silicon,
0.7 to 2.0% manganese, with the balance being iron and unavoidable impurities and wherein the ratio of Si/Mn is between 0.6 to 1.5 and the sulfur content is less than or equal to 0.02% as an unavoidable impurity, said composition being in the form of a rolled sheet having high ductility and thoughness in all directions independent of the rolling direction, said sheet having a total elongation measured in any direction of not less than 41%, a reduction of area measured in any direction of not less than 81%, and a tensile strength measured in any direction of not less than 50 kg/mm², and an n value of not less than 0.27, and wherein for a given sheet, each of said properties is substantially the same regardless of in which direction the property is measured.

2. A composition according to claim 1, in which the ratio of Si/Mn is between 0.8 and 1.1.

3. A composition according to claim 1, in which the content of S is not more than 0.01%.

4. A composition according to claim 1 which further comprises one or both of Ce and Zr so as to attain the ratio of Ce/S = 1.5 to 2.0 and Zr/S >2 respectively.

5. A high silicon steel composition consisting essentially of:

0.03 to 0.15% carbon,
0.7 to 2.3% silicon,
0.7 to 2.0% manganese,
less than 0.5% chromium, with the balance being iron and unavoidable impurities and wherein the ratio of Si/Mn is between 0.6 to 1.5 and the sulfur content is less than or equal to 0.02% as an unavoidable impurity, said composition being in the form of a rolled sheet having high ductility and toughness in all directions independent of the rolling direction, said sheet having a total elongation measured in any direction of not less than 41%, a reduction of area measured in any direction of not less than 81%, and a tensile strength measured in any direction of not less than 50 kg/mm², and an n value of not less than 0.27, and wherein for a given sheet, each of said properties is substantially the same regardless of in which direction the property is measured.

6. A high silicon steel composition consisting essentially of:

0.03 to 0.15% carbon,
0.7 to 2.3% silicon,
0.7 to 2.0% manganese,
less than 0.5% chromium,
not more than 0.4% of an element
selected from the group consisting of
Nb, V, and Ti, with the balance being iron and unavoidable impurities and wherein the ratio of Si/Mn is between 0.6 to 1.5 and the sulfur content is less than or equal to 0.02% as an unavoidable impurity, said composition being in the form of a rolled sheet having high ductility and toughness in all directions independent of the rolling direction, said sheet having a total elongation measured in any direction of not less than 34%, a reduction of area measured in any direction of not less than 80%, and a tensile strength measured in any direction of not less than 50 kg/mm², and an n value of not less than 0.19, and wherein for a given sheet, each of said properties is substantially the same regardless of in which direction the property is measured.

7. A high silicon steel composition consisting essentially of:

0.03 to 0.15% carbon,
0.7 to 2.3% silicon,
0.7 to 2.0% manganese, one or more elements selected from the group consisting of Cr, Nb, V, Ti, Al, and Cu, the amount of Cr and Cu being not more than 0.5%, the amount of Nb, V, and Ti being not more than 0.4%, and the amount of Al being not more than 0.1%, with the balance being iron and unavoidable impurities and wherein the ratio of Si/Mn is between 0.6 to 1.5 and the sulfur content is less than or equal to 0.02% as an unavoidable impurity, said composition being in the form of a rolled sheet having high ductility and toughness in all directions independent of the rolling direction, said sheet having a total elongation measured in any direction of not less than 41%, a reduction of area measured in any direction of not less than 78%, and a tensile strength measured in any direction of not less than 50 kg/mm$^2$, and an n value of not less than 0.27, and wherein for a given sheet, each of said properties is substantially the same regardless of in which direction the property is measured.

* * * * *

UNITED STATES PATENT OFFICE

CERTIFICATE OF CORRECTION

Patent No. 4,043,805 Dated August 23, 1977

Inventor(s) Satohiro Hayami, et al

It is certified that error appears in the above-identified patent and that said Letters Patent are hereby corrected as shown below:

Column 9, line 49, before "less" delete "not",
line 50, before "less" delete "not", Column 10, line 26, before "less" delete "not",
line 27, before "less" delete "not",
line 49, before "less" delete "not",
line 50, before "less" delete "not", Column 11, line 4, before "less" delete "not",
line 6, before "less" delete "not".

Signed and Sealed this

Tenth Day of April 1979

[SEAL]

Attest:

RUTH C. MASON
Attesting Officer

DONALD W. BANNER
Commissioner of Patents and Trademarks

UNITED STATES PATENT OFFICE

CERTIFICATE OF CORRECTION

Patent No. 4,043,805 Dated August 23, 1977

Inventor(s) Satohiro Hayami, et al

It is certified that error appears in the above-identified patent and that said Letters Patent are hereby corrected as shown below:

Column 9, line 52, before "less" delete "not",

Column 10, line 29, before "less" delete "not", line 52, before "less" second occurrence, delete "not", Column 12, line 2, before "less" delete "not".

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*